United States Patent [19]

Fleshler

[11] Patent Number: 4,516,656

[45] Date of Patent: May 14, 1985

[54] ACOUSTICAL ATTENUATING DEVICE AND CHAIR EQUIPPED THEREWITH

[76] Inventor: Bernard Fleshler, 67 Covington Rd., Buffalo, N.Y. 14216

[21] Appl. No.: 448,320

[22] Filed: Dec. 9, 1982

[51] Int. Cl.[3] ..... G10K 11/00

[52] U.S. Cl. ..... 181/175; 181/296; 181/290

[58] Field of Search ..... 181/175, 30, 295, 296, 181/DIG. 1, 290, 284; 179/146 H, 148 R, 151, 150, 149

[56] References Cited

U.S. PATENT DOCUMENTS

| | | | |
|---|---|---|---|
| 3,452,836 | 7/1969 | Carsello et al. | 179/146 |
| 3,780,825 | 12/1973 | Rinaldi | 181/175 |
| 4,042,791 | 8/1977 | Wiseman | 179/146 |
| 4,093,482 | 6/1978 | Ogata et al. | 156/210 |

OTHER PUBLICATIONS

Westmore, G. A., Noise Induced Hearing Loss and Orchestral Musicians, *Archives of Otolaryngology,* vol. 107, 761-764, 1981.

Meyer, J. J., A Study of High Noise Levels in Symphony Orchestras, 1974.

*Primary Examiner*—John Gonzales
*Assistant Examiner*—Brian W. Brown
*Attorney, Agent, or Firm*—Howard M. Ellis

[57] ABSTRACT

An acoustical device for reducing sound pressure levels and the potential for noise induced hearing loss comprising an arched shaped acoustic pad having an interior or frontal concave sound absorption panel and an exterior or rear convex sound shield supported by an interior frame member. Sound attenuation is accomplished by enclosing the frame with at least one layer of resilient material having a high sound absorption coefficient. The acoustic pad is affixed to the back of a musician's chair by means of a mounting device which provides a high degree of flexibility in positioning for optimal directional protection of the performer.

21 Claims, 8 Drawing Figures

Fig. 5.
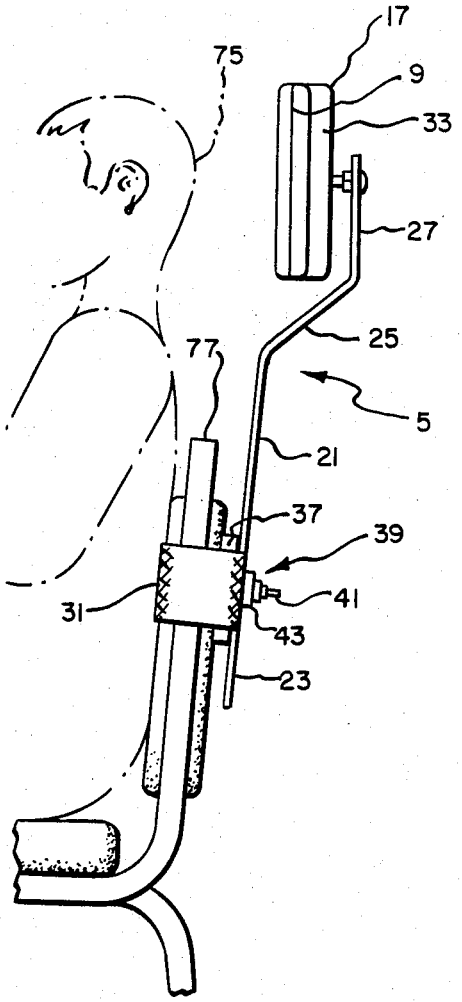
Fig. 6.
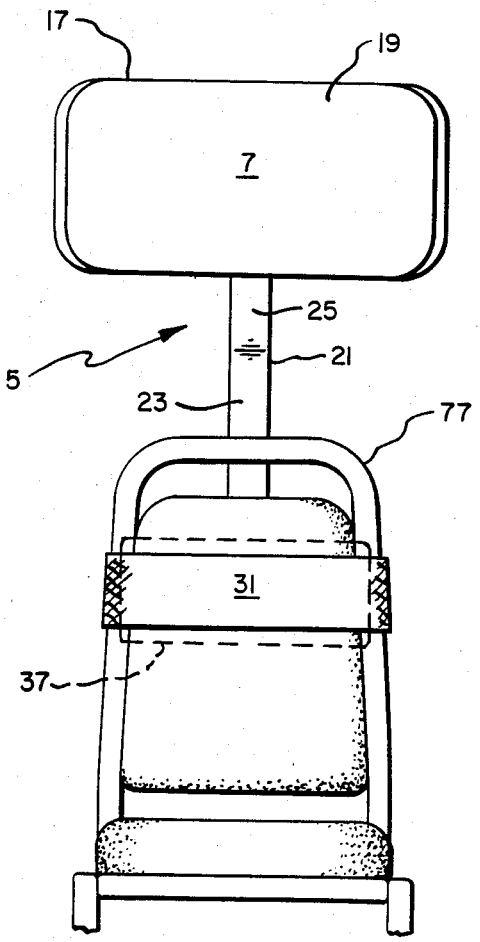
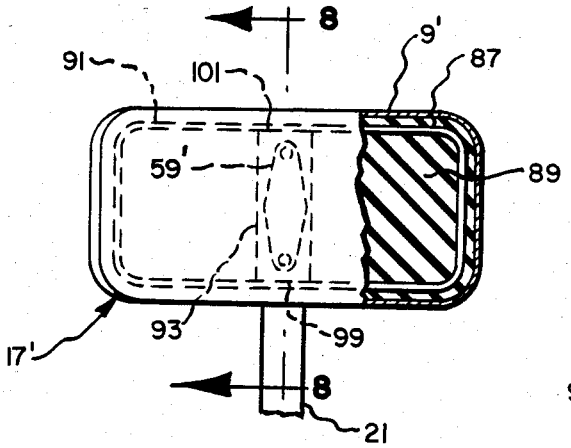
Fig. 7.
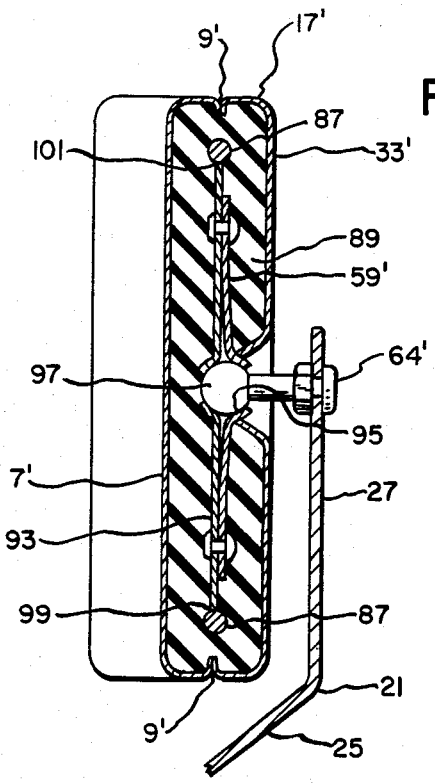
Fig. 8.

ACOUSTICAL ATTENUATING DEVICE AND CHAIR EQUIPPED THEREWITH

BACKGROUND OF THE INVENTION

The present invention relates to a device for reducing the potentially harmful effects of high sound pressure levels on orchestral musicians. More particularly, the present invention relates to an acoustical device for use on chairs of individual performers, which operates to effectively lower the sound pressure level and incidence of noise induced hearing loss.

While much attention has been given to sound pressure levels generated by pop musicians, and particularly the highly amplified sounds generated by rock bands, relatively little attention has been focused on solving the problem of high sound pressure levels on individual orchestral musicians. Nonetheless, performers seated, for instance, in front of and in close proximity to the brass and percussion sections of an orchestra, such as the woodwinds, strings and brass are exposed to sound pressure levels which can result in hearing loss.

Guidelines for permissible noise levels have been determined by the U.S. Department of Labor, Occupational Safety, which limits sound levels, for example, of 90 dbA to a maximum time period of up to 8 hours per day whereas exposure to sound levels of 115 dbA should not exceed fifteen minutes in duration per day. Still, noise induced hearing loss is found to be prevalent among professional orchestral musicians, who are exposed to high sound pressures on a daily basis, as a result of lengthy rehearsals, recording sessions, etc., where the duration of exposure exceeds the recommended safe occupational maximums.

Previous efforts to solve the problem of noise induced hearing loss among orchestral musicians have not been totally satisfactory. For example, various free standing baffle systems have been employed between sections of the orchestra in order to shield performers. However, the baffles in most instances were large and cumbersome to handle and difficult to transport when the orchestra was scheduled for out of town appearances. Moreover, because such baffle systems were physically large in size they were always quite prominent to the audience, and therefore, detracted from the general esthetic appearance of the orchestra. Alternatively, ear plugs have been used by individual performers. Such devices were effective in reducing sound pressure levels, but nevertheless, interfered with the ability to hear and gauge the pitch and tonal quality of play of neighboring musicians in the orchestra. Consequently, plugging the ears is not viewed as an ideal solution to the problem of noise induced hearing loss. Elevating the percussion and brass sections of the orchestra has also been tried with less then satisfactory results. A reduction in sound pressure levels directly on the ear may be achieved by use of orchestral risers, but actual performance is dependent on musicians raising and maintaining the bells of their instruments in an elevated position. Accordingly, there is a need for an improved and dependable sound attenuating device which will offer the necessary occupational safeguards to orchestral musicians without trade-offs in musician performance and convenience.

The present invention provides a novel means for reducing the potentially harmful effects of high sound pressures and related loss of hearing without interfering with normal hearing processes. The basic design of the device eliminates the need for large, unattractive baffle systems and the problem of transporting when on tour. It is both hand portable and easily mountable to the backside of virtually any musician's chair.

SUMMARY OF THE INVENTION

The problem of noise induced hearing loss among orchestral musicians due to environmentally high sound pressure levels is remedied according to the teachings of the present invention by means of a sound attenuating device affixed to the back of a musician's chair. The device comprises an arched shaped acoustic pad mounted over the chair back such that the pad is proximal to the performer's head, but avoids physical contact with the head and other parts of the body when the musician moves either forwardly, backwardly or laterally while performing. Thus, the relatively small acoustic pad comprising an interior or frontal concave shaped sound absorption panel and an exterior or rear convex shaped sound shield has sufficient surface area to circumscribe the backside of the performer's head to shield and absorb sound, but without interfering with or placing limitations on the free and natural movements of the performer.

The arched shaped acoustic pad which operates much by shielding and absorbing sound is comprised of an interior frame member enclosed by at least one layer of material which provides optimal sound attenuating properties thereby lowering the intensity of potentially harmful sound pressures reaching the performer's ears. Because the main objectives of the invention disclosed herein are to reduce the exposure to high sound pressure levels with a relatively small, light weight acoustical device the need for properties beyond those stated eg..shock absorbency from sudden impact, are neither required nor deemed advantageous.

BRIEF DESCRIPTION OF THE DRAWINGS

For a further understanding of the present invention, as well as characterizing features, reference should now be made to the following detailed description thereof taken in conjunction with the accompanying drawings, wherein:

FIG. 5 is a side elevational view of the inventive device mounted on a conventional orchestral chair and illustrating in dot dash lines a human figure positioned for the device when in use.

FIG. 6 is a front elevational view of the device shown in FIG. 5.

FIG. 7 is a fragmentary front elevational view of a modified form of the sound attenuating device, and FIG. 8 is an enlarged vertical central sectional view taken generally on line 8—8 of FIG. 7.

DETAILED DESCRIPTION OF THE PREFERRED EMBODIMENTS

Figure 2:
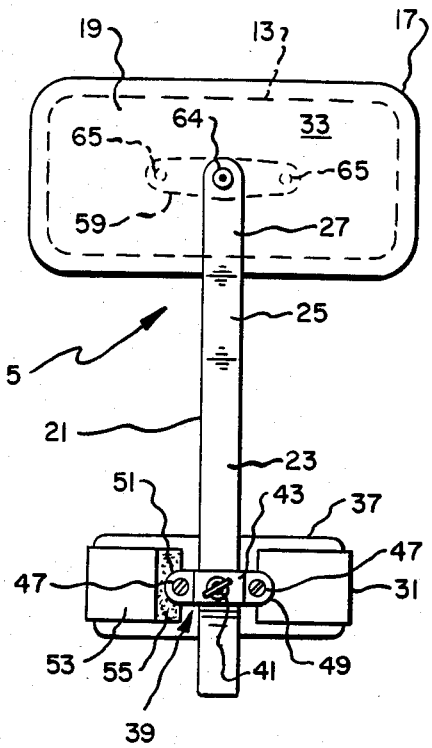
FIG. 2 is a rear elevational view of the device illustrated in FIG. 1.
Figure 3:
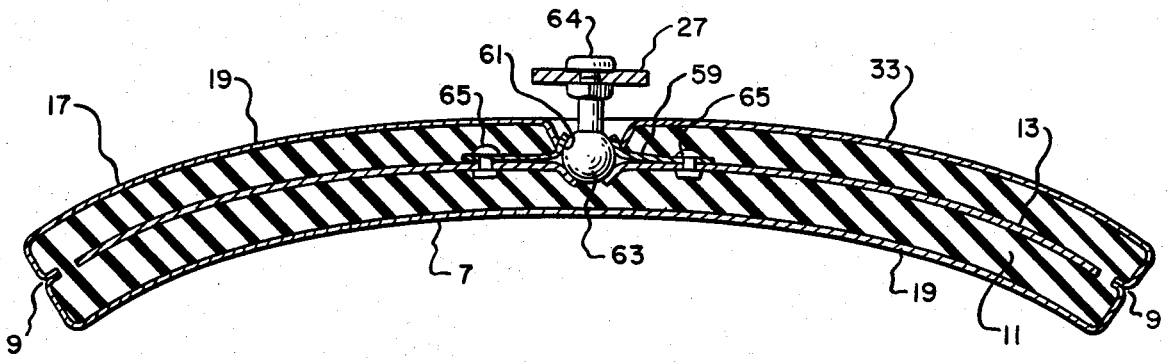
FIG. 3 is an enlarged horizontal sectional view taken generally on line 3—3 of FIG. 1 and illustrating the pivotal mounting of the acoustic pad.

Referring in detail to the drawings, the acoustical attenuating device according to the present invention is generally depicted at 5 (FIG.1), and includes an arched or bow shaped acoustic pad 17 and 17' (FIGS. 7 and 8) supported by a mounting member 21 for affixing to the back of a musician's chair, such as illustrated in FIG. 6. The acoustic pad is comprised of an interior or frontal concave shaped sound absorption panel 7 and 7' (FIG. 8) and an external or rear convex shaped sound shield 33 (FIG. 2) and 33' (FIG. 8). The generally curved configuration of acoustic pad 17 and 17' is best illustrated by FIG. 3.

Figure 1:
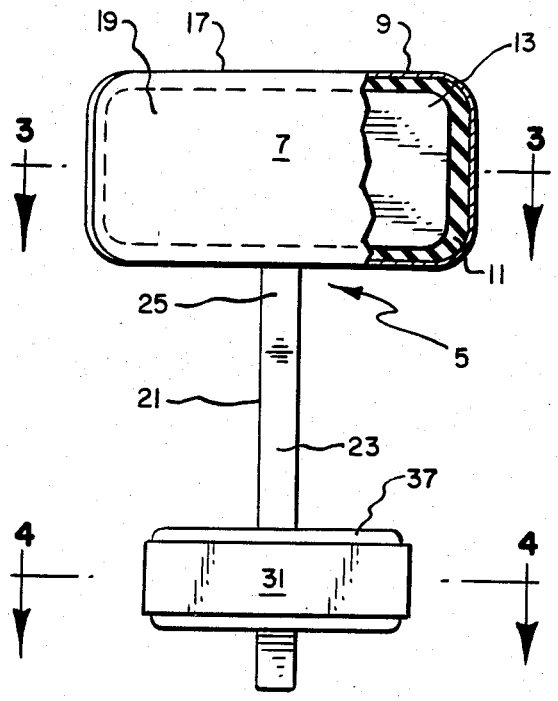
FIG. 1 is a front elevational view of the inventive sound attenuating device with parts broken away to disclose the underlying structure.

Construction of the acoustic pad includes an interior frame 13 which may be a solid, non-hollow plate as illustrated in FIG. 1 suitably formed from any light weight material eg.. sheet metal, aluminum, molded plastic, and the like. The shape of frame 13, best illustrated in FIG. 3, is generally an arched configuration similar to that of the acoustic pad per se. Thus, the frame in addition to providing both form and support also imparts added sound shielding properties to the acoustic pad.

As an alternative to the solid plate type frame, the interior of the acoustic pad may be fabricated with an open peripheral type from 87 (FIGS. 7 and 8) which may be either a solid metal bar or wire, or hollow tubular material which extends along the peripheral edges of the pad as outlined at 91. As in the case of the solid, non-hollow type frame plate, the peripheral type frame coincides with the general arched configuration of the acoustic pad. The open peripheral type frame allows for especially light weight construction.

Frames 13 and 87 are covered with at least one layer of sound absorbing material 11 and 89, said material preferably being both resilient and porous eg.. foamed plastic or rubber elastomer, carpeting or similar type materials having high sound absorption coefficients. Frame 13 is covered on both the interior concave and exterior convex sides with sound absorbing material 11 forming frontal sound absorption panel 7 and rear sound shield 33. Additional layers of material may be used to cover the pad to provide further sound attenuating properties to the device, as well as improving its general appearance. For example, a plush type fabric, such as a velour or velvet may be applied as an outer layer sound absorbing material. This outer layer may be applied to both the frontal concave shaped sound absorbing panel and to the rear convex shaped sound shield. The outer layers are joined around the periphery of the acoustic pad by seam 9 and 9' (FIGS. 7 and 8) encasing all surfaces of the pad, including front, rear and side edges by exterior fascia 19.

The acoustic pad should possess sufficient surface area to circumscribe the backside of the user's head. Such size limitations are preferably not exceeded, since a pad of larger dimensions may only interfere with rearwardly seated performers' visual contact with the conductor. Similarly, the degree of curvature of the arched acoustic pad, as illustrated in FIG. 3, should also be adequate to circumscribe the user's ears to provide adequate protection from lateral sound pressures while also avoiding visual interference.

The acoustic pad is supported by affixing over a chair back 77 as generally depicted by FIGS. 5 and 6. For purposes of illustration only the sound attenuating device disclosed herein will be shown with means for detachably mounting onto a previously manufactured chair. However, it is to be understood the subject concept also embodies the acoustical device being incorporated into the back of a chair whereby it is an integral component of the chair.

The positioning of the acoustic pad over the back of a chair plays an important role in so far as achieving maximum effectiveness in reducing exposure to high level sound pressures. Likewise, in mounting the acoustic pad it should be positioned proximate to the user's head 75, but without making physical contact which will restrict or inhibit lateral, forward or backward movements of the performer's head, limbs and torso. Accordingly, the device disclosed herein includes means for adjusting both the height and angle of the pad relative to the user's body for optimal positioning and effectiveness in reducing high sound pressures. The need for such flexibility in movement and positioning may be demonstrated where, for example, the brass and percussion sections of an orchestra may be stationed in an elevated position relative to the woodwind and string sections. Under such circumstances, the acoustic pads affixed to the chair backs in the viola section located somewhat below the brass and percussion sections, are best adjusted by a pivotal movement whereby the upper edge of the pad is tilted forwardly while the lower edge is moved rearwardly. In this manner, the sound attenuating device provides ideal directional protection from high sound pressure levels.

The mounting system includes support member 21 consisting of a lower, substantially vertical mounting bar 23, an intermediate support bar 25 and an upper vertical mounting bar 27. The lower, intermediate and upper bar sections of support member 21 may be in a continuous substantially vertical plane with the chair back. However, FIG. 5 best illustrates a preferred embodiment wherein intermediate support bar 25 is flaired rearwardly at an angle. Support bar 27 then continues in an upward direction along a substantially vertical plane parallel with lower support bar 23.

Support member 21 interconnects with a lower mounting bracket 39 consisting of a threaded locking bolt 41 and a carriage 43 affixed to a rear mounting plate 37 by threaded fasteners 47. A flexible frontal mounting belt 31 surrounds the opposing face of the rear mounting plate 37 wherein the terminal ends of the belt are anchored to the backside of said plate by clamping under carriage 43 at points 49 and 51. Mounting belt 31 may be fabricated from virtually any flexible material, including leather or canvas. The belt may form either a continuous loop with rear mounting plate 37, or alternatively, one end of belt 31 may be detachably connected to the backside of the plate by means of various fasteners of conventional design, including flexible type fastening system where, for instance, terminal end 53 of belt 31 interconnects with facing 55 on contact. Fasteners of this type are readily available commodities of commerce, and are marketed under various trademarks, one such example being "Velcro".

Figure 4:
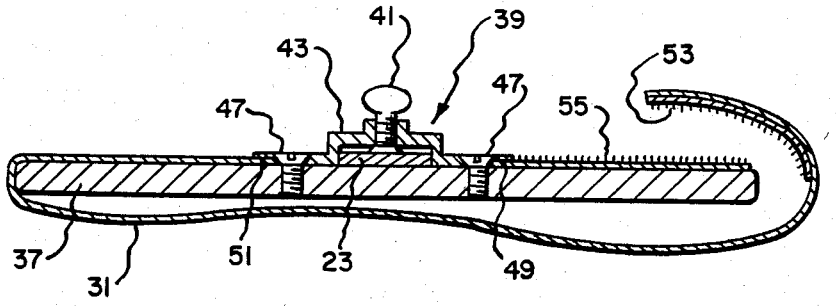
FIG. 4 is an enlarged horizontal sectional view taken generally on line 4—4 of FIG. 1 and illustrating the mounting means.

The lower mounting assembly and its attachment to a chair back is best illustrated by FIGS. 5 and 6 where the outline of rear mounting plate 37 carrying lower mounting bracket 39 (FIG. 4) makes firm contact with the backside of chair back 77. Mounting belt 31 interconnected with rear mounting plate 37 wraps around the frontside of the chair back, and because of its resilient properties will not interfere with the comfort of the performer. Mounting bar 23 (FIG. 4) is inserted into carriage 43 whereby the desired height of the pad may be adjusted either upwardly or downwardly by loosening and tightening locking bolt 41.

FIG. 6 illustrates arched shaped acoustic pad 17 affixed to mounting bar 21 so it is elevated over chair back 77. The acoustic pad may be attached to the upper vertical mounting bar 27 by means of an upper mounting bracket 59, FIG. 2. Upper mounting bracket 59 is affixed to the backside of interior frame plate 13 which in-turn is mounted to bar 27 through connecting pin 64.

Although upper mounting bracket 59 may be of a stationary non-adjustable design, preferably acoustic pad 17 is affixed to mounting bar 27 whereby said pad is easily adjusted by pivotal movements in virtually any direction. FIGS. 3 and 8 best illustrate means for pivotal positioning of the arched shape acoustic pad 17 and 17'. FIG. 3 shows solid, non-hollow frame plate 13 having a centrally located socket 61 carrying ball 63. Ball and socket assembly 63 and 61 may be attached directly to the frame plate by connecting pins 65. The ball is connected to upper vertical mounting bar 27 by means of connecting pin 64.

The open peripheral frame 87 (FIGS. 7 and 8) is also equipped with an upper mounting bracket 59' for pivotal positioning of the arched acoustic pad 17', as generally outlined at 93. Ball 97 and socket 95 assembly of bracket 59' extending from the upper and lower peripheral frame sections are connected at points 99 and 101. Connecting pin 64' is used to affix the ball and socket assembly to upper vertical mounting bar 27.

The following specific example demonstrates the subject matter of the instant invention, however, it is to be understood that this example is for illustrative purposes only and does not purport to be wholly definitive as to conditions and scope.

EXAMPLE

A series of audiometric tests were conducted to determine the overall effectiveness of the acoustical device disclosed herein for reducing the intensity of high sound pressure levels similar to those noise levels orchestral musicians are exposed to under working conditions.

Two different acoustic pads were fabricated for testing. The first pad was constructed with a solid interior frame plate fabricated from sheet metal. The frame had an arched configuration similar to that shown in FIG. 3 of the drawings. The interior concave and exterior convex surfaces were each covered with a single mat of conventional medium weight plush type carpeting trimed to conform with the shape of the frame. The carpet backing in each instance was in juxtaposition with the solid frame plate. The entire frame was then wrapped and covered with a single layer of black valour fabric. The edges of the pad were finished by forming a seam. It was then labeled Acoustic Pad No. 1.

A second pad was fabricated also using a solid, non-hollow frame plate of the type employed in Acoustic Pad No. 1. However, instead of covering the frame plate with carpeting, a ¾ inch thick layered sheet of an acoustical polyurethane foam product made by the Soundcoat Company, Inc., Brooklyn, N.Y., and available under the trademark Soundmat LF Embossed, was applied to both sides of the frame plate. The frame was then covered with black valour fabric and seamed along the outer edges. It was then labeled Acoustic Pad No. 2.

Testing of each of the foregoing acoustic pads was conducted in a room of approximate size of 30 feet by 18 feet with about a 9 foot high ceiling. The floor of the test room was covered with area rugs, but the windows were free of draperies. The room was furnished with various upholstered and wooden, nonupholstered pieces of furniture.

Before connecting the test acoustic pads to a chair appropriate control tests were conducted by measuring the sound intensity produced by five separate and sustained blasts on a B flat trumpet with a B flat tone of 469 cps generated by a professional orchestral musician seated five feet behind the backside of the chair. The sound intensity was measured using a Simpson brand Sound level meter, Model 885 placed above the chair back, and one foot forward, so that it was positioned a total of six feet from the trumpet. Data generated from the control testing is recorded below in the Table.

Subsequently, the acoustic pad labeled No. 1 was affixed to the back of the same chair using a mounting system similar to that illustrated in FIG. 1, except the pad was not connected to the mounting bar by means of a pivotal positioning ball and socket system. The trumpet was sounded for five separate and sustained blasts after the sound level meter was placed one foot in front of the interior concave shaped sound absorption panel of the acoustic pad. The total distance between the meter and the pad was six feet. Data from each of the test blasts is recorded below in the Table.

The acoustic pad labeled No. 1 was removed from the mounting bar and replaced with the pad labeled No. 2. Five separate tests were conducted with the trumpet also being the sound source, under the same conditions as those in which pad No. 1 was tested.

TABLE

| | Control (dbA) | Acoustic Pad No. 1 (dbA) | Acoustic Pad No. 2 (dbA) |
|---|---|---|---|
| 1 | 107 | 100 | 100 |
| 2 | 106 | 98 | 102 |
| 3 | 108 | 97 | 100 |
| 4 | 107 | 98 | 101 |
| 5 | 108 | 99 | 100 |
| Average | 107.2 | 98.4 | 100.6 |

On a logarithmic scale, an approximate absorption of 10 dbA represents a reduction in sound pressure level of more than 75 percent. Accordingly, Pad No. 1 provided better than a 65 percent reduction in sound level and Pad No. 2 provided at least a 49 percent reduction. In addition to the objective test data, it has also been observed through actual use of the device by orchestral musicians that high sound frequencies appear to be substantially diminished thereby reducing adverse environmental stress type reactions.

While the invention has been described in conjunction with specific examples thereof this is illustrative only. Accordingly, many alternatives, modifications and variations will be apparent to those skilled in the art in light of the foregoing descriptions and it is therefore intended to embrace all such alternatives, modifications and variations as to fall within the spirit and broad scope of the appended claims.

What is claimed is:

1. A sound attenuating device affixable to the back of a chair, which comprises a generally arched shaped acoustic pad having a rear sound shield and a frontal sound absorption panel, the pad being sufficiently arched to circumscribe the backside of the user's head and ears without covering the side of the user's head, said device including means for mounting the pad over the chair back such that the frontal sound absorption panel is proximate to the user's head.

2. The sound attenuating device of claim 1 wherein the mounting means includes means for adjustably raising and lowering the acoustic pad in a substantially vertical plane.

3. The sound attenuating device of claim 1 wherein said mounting means includes means for pivotal positioning of the acoustic pad.

4. The sound attenuating device of claim 1 wherein the arched shaped acoustic pad is substantially concave shaped and is proximate to the user's head without making contact therewith.

5. The sound attenuating device of claim 4 wherein the acoustic pad includes an internal framing member.

6. The sound attenuating device of claim 5 wherein the internal framing member is a substantially solid, non-hollow plate having a size and shape approximately equivalent to the acoustic pad.

7. The sound attenuating device of claim 5 wherein the acoustic pad comprises an open peripheral frame covered with at least one layer of a resilient sound absorbing material.

8. The sound attenuating device of claim 7 wherein the peripheral frame is enclosed by at least one layer of foamed plastic or rubber.

9. An acoustical chair, which comprises in combination a seat, a back, means for supporting the seat and back and a sound attenuating device positioned over the back and mounted thereto, said device comprising a generally arched shaped acoustic pad having a frontal sound absorption panel and a rear sound shield, the pad being sufficiently arched to circumscribe the backside of the user's head and ears without covering the side of the user's head, the frontal sound absorption panel being proximate to the user's head.

10. The acoustical chair of claim 9 wherein the mounting means for the sound attenuating device includes adjustable means for raising and lowering the acoustic pad in a substantially vertical plane.

11. The acoustical chair of claim 9 wherein the mounting means for the sound attenuating device includes means for pivotal positioning of the acoustic pad.

12. The acoustical chair of claim 9 wherein the chair back is substantially vertical and the arched shaped acoustic pad is substantially concave shaped, said pad including an internal framing member.

13. The acoustical chair of claim 12 wherein the internal framing member is a substantially solid, non-hollow plate having a size and shape approximately equivalent to the acoustic pad.

14. The acoustical chair of claim 12 wherein the acoustic pad comprises an open peripheral frame enclosed by at least one layer of a resilient sound absorbing material.

15. A method for reducing the potential for noise induced hearing loss among musicians, which method comprises the steps of (A) affixing a sound attenuating device to a chair, said device comprising a generally arched shaped acoustic pad having a rear sound shield and a frontal sound absorption panel, the pad being sufficiently arched to circumscribe the backside of the user's head and ears without covering the side of the user's head, and (B) aligning the pad such that it shields the musician's head from exposure to high sound pressure.

16. The method of claim 15 wherein the acoustic pad includes an internal framing member for supporting the rear sound shield and frontal sound absorption panel.

17. The method of claim 15 wherein the mounting means for the sound attenuating device includes means for adjustably raising and lowering the acoustic pad in a vertical plane and means for pivotal positioning of said pad.

18. A sound attenuating device affixable to a chair, which comprises a substantially concave shaped, sound absorbing acoustic pad having a frontal sound absorption panel and a rear sound shield, the pad being sufficiently arched to circumscribe the backside of the user's head and ears without covering the side of the user's head, said pad including an internal framing member in the form of a substantially solid, non-hollow plate enclosed by at least one layer of resilient sound absorbing material, said device being equipped with means for mounting to a chair such that the pad is proximate to the user's head.

19. The sound attenuating device of claim 18 wherein the resilient sound absorbing material comprises at least one layer of foamed plastic or rubber.

20. An acoustical chair, which comprises in combination a seat, a back and means for supporting the seat and back and a sound attenuating device mounted thereto, said device comprising a substantially concave shaped, sound absorbing acoustic pad having a frontal sound absorption panel and a rear sound shield, the pad being sufficiently arched to circumscribe the backside of the user's head and ears without covering the side of the user's head, said pad including an internal framing member in the from of a substantially solid, non-hollow plate enclosed by at least one layer of a resilient sound absorbing material.

21. A method for reducing the potential for noise induced hearing loss, which comprises the steps of (A) providing a chair with a sound attenuating device affixed thereto, said device comprising a generally arched shaped, sound absorbing acoustic pad having a rear sound shield and a frontal sound absorption panel, the pad being sufficiently arched to circumscribe the backside of the user's head and ears without covering the side of the user's head, said pad including an internal framing member enclosed by at least one layer of resilient sound absorbing material, and (B) aligning the pad such that it shields the user's head from exposure to high sound pressure.

* * * * *